US011808411B2

(12) United States Patent
Lee et al.

(10) Patent No.: US 11,808,411 B2
(45) Date of Patent: Nov. 7, 2023

(54) CARGO STRIPPING FEATURES FOR DUAL-PURPOSE CRYOGENIC TANKS ON SHIPS OR FLOATING STORAGE UNITS FOR LNG AND LIQUID NITROGEN

(71) Applicant: EXXONMOBIL TECHNOLOGY AND ENGINEERING COMPANY, Spring, TX (US)

(72) Inventors: Donghwan Lee, The Woodlands, TX (US); Sathish Balasubramanian, The Woodlands, TX (US)

(73) Assignee: EXXONMOBIL TECHNOLOGY AND ENGINEERING COMPANY, Spring, TX (US)

( * ) Notice: Subject to any disclaimer, the term of this patent is extended or adjusted under 35 U.S.C. 154(b) by 699 days.

(21) Appl. No.: 16/917,038

(22) Filed: Jun. 30, 2020

(65) Prior Publication Data

US 2021/0088185 A1 Mar. 25, 2021

Related U.S. Application Data

(60) Provisional application No. 62/904,966, filed on Sep. 24, 2019.

(51) Int. Cl.
*F17C 7/00* (2006.01)
*F17C 7/04* (2006.01)
(Continued)

(52) U.S. Cl.
CPC ..... *F17C 7/04* (2013.01); *F04B 15/08* (2013.01); *F17C 6/00* (2013.01); *B63B 25/16* (2013.01);
(Continued)

(58) Field of Classification Search
CPC ..... F17C 7/02; F17C 7/04; F17C 9/02; F17C 9/04; F17C 2265/06
See application file for complete search history.

(56) References Cited

U.S. PATENT DOCUMENTS 1,914,337 A 6/1933 Belt
1,974,145 A 9/1934 Atwell
(Continued)

FOREIGN PATENT DOCUMENTS

CN 102620523 10/2014
CN 102628635 10/2014
(Continued)

OTHER PUBLICATIONS

Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan, 1, 1990, pp. 31-37.
(Continued)

*Primary Examiner* — Brian M King
(74) *Attorney, Agent, or Firm* — Vorys, Sater, Seymour and Pease LLP

(57) ABSTRACT

An apparatus and method of storing and transporting, in a dual-use cryogenic storage tank, a cryogenic liquid having a liquefaction temperature. A first pump empties the tank of a first portion of the cryogenic liquid, thereby leaving a second portion of the cryogenic liquid in the cryogenic storage tank. A second portion of the cryogenic liquid is focused at a location on a bottom of the cryogenic storage tank. Using a second pump located at the location, the cryogenic storage tank is emptied of the second portion of the cryogenic liquid, whereby a residual portion of the cryogenic liquid is left therein. Using a focused heating structure, heat may be delivered to the location to raise the temperature of the
(Continued)

residual portion above the liquefaction temperature, thereby vaporizing all of the residual portion.

19 Claims, 6 Drawing Sheets

(51) Int. Cl.
*F04B 15/08* (2006.01)
*F17C 6/00* (2006.01)
*B63B 25/16* (2006.01)
*B63B 25/08* (2006.01)

(52) U.S. Cl.
CPC . *B63B 2025/087* (2013.01); *F17C 2223/0161* (2013.01)

(56) References Cited

U.S. PATENT DOCUMENTS 2,007,271 A 7/1935 Frankl
2,011,550 A 8/1935 Hasche
2,321,262 A 6/1943 Taylor
2,361,865 A * 10/1944 Norway ..... F17C 13/04 222/3
2,475,255 A 7/1949 Rollman
2,537,045 A 1/1951 Garbo
2,900,797 A 8/1959 Kurata et al.
2,975,604 A 3/1961 McMahon
2,986,010 A 5/1961 Beckwith
3,014,082 A 12/1961 Woertz, III
3,018,632 A 1/1962 Keith
3,103,427 A 9/1963 Jennings
3,180,709 A 4/1965 Yendall et al.
3,347,055 A 10/1967 Blanchard et al.
3,370,435 A 2/1968 Arregger
3,376,709 A 4/1968 Dickey et al.
3,398,544 A 8/1968 Crownover
3,400,512 A 9/1968 McKay
3,400,547 A 9/1968 Williams, V et al.
3,511,058 A 5/1970 Becker
3,724,225 A 4/1973 Mancini et al.
3,724,226 A 4/1973 Pachaly
3,850,001 A 11/1974 Locke
3,877,240 A * 4/1975 Kniel ..... F25J 1/0277 62/53.2
3,878,689 A 4/1975 Grenci
4,281,518 A 8/1981 Muller et al.
4,415,345 A 11/1983 Swallow
4,521,322 A 6/1985 Broussoux et al.
4,533,372 A 8/1985 Valencia et al.
4,604,115 A 8/1986 Bonneton et al.
4,609,388 A 9/1986 Adler et al.
4,669,277 A 6/1987 Goldstein
4,769,054 A 9/1988 Steigman
4,923,493 A 5/1990 Valencia et al.
5,025,860 A 6/1991 Mandrin
5,062,270 A 11/1991 Haut et al.
5,120,338 A 6/1992 Potts, Jr. et al.
5,137,558 A 8/1992 Agrawal
5,139,547 A 8/1992 Agrawal et al.
5,141,543 A 8/1992 Agrawal et al.
5,638,698 A 6/1997 Knight et al.
5,865,605 A * 2/1999 Weidlein ..... F04B 23/023 417/423.15
5,950,453 A 9/1999 Bowen et al.
6,003,603 A 12/1999 Breivik et al.
6,053,007 A 4/2000 Victory et al.
6,082,133 A 7/2000 Barclay et al.
6,158,242 A 12/2000 Lu
6,237,347 B1 5/2001 Rigby et al.
6,295,838 B1 10/2001 Shah et al.
6,298,688 B1 10/2001 Brostow et al.
6,308,531 B1 10/2001 Roberts et al.
6,412,302 B1 7/2002 Foglietta
6,662,589 B1 12/2003 Roberts et al.
6,889,522 B2 5/2005 Prible et al.
7,143,606 B2 12/2006 Tranier
7,219,512 B1 5/2007 Wilding et al.
7,278,281 B2 10/2007 Yang et al.
7,325,415 B2 2/2008 Amin et al.
7,386,996 B2 6/2008 Fredheim et al.
7,520,143 B2 4/2009 Spilsbury
7,591,487 B2 9/2009 Smith, III et al.
7,712,331 B2 5/2010 Dee et al.
8,079,321 B2 12/2011 Balasubramanian
8,435,403 B2 5/2013 Sapper et al.
8,464,289 B2 6/2013 Pan
8,601,833 B2 12/2013 Dee et al.
8,616,012 B2 12/2013 Duerr et al.
8,616,021 B2 12/2013 Minta
8,747,520 B2 6/2014 Bearden et al.
9,016,088 B2 4/2015 Butts
9,149,761 B2 10/2015 Northrop et al.
9,180,938 B2 11/2015 Yoo et al.
9,339,752 B2 5/2016 Reddy et al.
9,435,229 B2 9/2016 Alekseev et al.
9,439,077 B2 9/2016 Gupta et al.
9,459,042 B2 10/2016 Chantant et al.
9,995,521 B2 6/2018 Mogilevsky
10,294,433 B2 5/2019 Grainger et al.
10,400,953 B2 9/2019 Jin et al.
10,696,360 B2 6/2020 Balasubramanian
2006/0000615 A1 1/2006 Choi
2007/0277674 A1 12/2007 Hirano et al.
2008/0087421 A1 4/2008 Kaminsky
2008/0302133 A1 12/2008 Saysset et al.
2009/0217701 A1 9/2009 Minta et al.
2010/0192626 A1 8/2010 Chantant
2010/0251763 A1 10/2010 Audun
2011/0036121 A1 2/2011 Roberts et al.
2011/0126451 A1 6/2011 Pan et al.
2011/0259044 A1 10/2011 Baudat et al.
2012/0060553 A1 3/2012 Bauer
2012/0180657 A1 7/2012 Monereau et al.
2012/0285196 A1 11/2012 Fiinn et al.
2013/0074541 A1 3/2013 Kaminsky et al.
2013/0199238 A1 8/2013 Mock et al.
2014/0130542 A1 5/2014 Brown et al.
2015/0285553 A1 10/2015 Oelfke et al.
2016/0138758 A1* 5/2016 Nakano ..... F17C 3/022 220/565
2017/0010041 A1 1/2017 Pierre, Jr. et al.
2017/0016667 A1 1/2017 Huntington et al.
2017/0016668 A1 1/2017 Pierre, Jr. et al.
2017/0167785 A1 6/2017 Pierre, Jr. et al.
2017/0167786 A1 6/2017 Pierre, Jr.
2017/0167787 A1 6/2017 Pierre, Jr. et al.
2017/0167788 A1 6/2017 Pierre, Jr. et al.
2018/0231303 A1 8/2018 Pierre, Jr.
2018/0231305 A1 8/2018 Pierre, Jr.
2018/0292128 A1 10/2018 Degenstein et al.
2019/0344860 A1 11/2019 Koole et al.
2020/0248871 A1 8/2020 Kaminsky et al.

FOREIGN PATENT DOCUMENTS

DE 1960515 5/1971
DE 2354726 5/1975
DE 3149847 7/1983
DE 3622145 1/1988
DE 19906602 8/2000
DE 102013007208 10/2014
EP 1715267 10/2006
EP 1972875 9/2008
EP 2157013 8/2009
EP 2629035 8/2013
FR 2756368 5/1998
GB 1376678 12/1974
GB 1596330 8/1981
GB 2172388 9/1986
GB 2333148 7/1999
GB 2470062 11/2010
GB 2486036 11/2012

(56) References Cited

FOREIGN PATENT DOCUMENTS

| | | |
|---|---|---|
| JP | 59216785 | 12/1984 |
| JP | 2530859 | 4/1997 |
| JP | 5705271 | 11/2013 |
| JP | 5357575 | 12/2013 |
| JP | 5518531 | 6/2014 |
| KR | 2010/0112708 | 10/2010 |
| KR | 2011/0079949 | 7/2011 |
| WO | WO2006/120127 | 11/2006 |
| WO | WO2008/133785 | 11/2008 |
| WO | WO2011/101461 | 8/2011 |
| WO | WO2012/031782 | 3/2012 |
| WO | WO2012/162690 | 11/2012 |
| WO | WO2014/048845 | 4/2014 |
| WO | WO2015/110443 | 7/2015 |
| WO | WO2016/060777 | 4/2016 |
| WO | WO2017/011123 | 1/2017 |
| WO | WO2017/055744 | 4/2017 |
| WO | WO2017/067871 | 4/2017 |
| WO | WO2018/203005 | 11/2018 |

OTHER PUBLICATIONS

Chang, Ho-Myung et al, (2019) "Thermodynamic Design of Methane Liquefaction System Based on Reversed-Brayton Cycle" Cryogenics, pp. 226-234.

ConocoPhillips Liquefied Natural Gas Licensing (2017) "Our Technology and Expertise are Ready to Work Toward Your LNG Future Today," http://lnglicensing.conocophillips.com/Documents/15-1106%20LNG%20Brochure_March 2016.pdf, Apr. 25, 2017, 5 pgs.

Danish Technologies Institute (2017) "Project—Ice Bank System with Pulsating and Flexible Heat Exchanger (IPFLEX)," https://www.dti.dk/projects/project-ice-bank-system-with-pulsating-andflexible-heat-exchanger-ipflex/37176.

Diocce, T. S. et al. (2004) "Atlantic LNG Train 4—The Worlds Largest LNG Train", *The 14th International Conference and Exhibition on Liquefied Natural Gas* (*LNG 14*), Doha, Qatar, Mar. 21-24, 2004, 15 pgs.

Kboo, C. T. et al. (2009) "Execution of LNG Mega Trains—The Qatargas 2 Experience," *WCG*, 2009, 8 pages.

Laforte, C. et al. (2009) "Tensile, Torsional and Bending Strain at the Adhesive Rupture of an Iced Substrate," *ASME 28th Int'l Conf. on Ocean, Offshore and Arctic Eng.*, OMAE2009-79458, 8 pgs.

McLachlan, Greg (2002) "Efficient Operation of LNG From the Oman LNG Project," *Shell Global Solutions International B.V.*, Jan. 1, 2002, pp. 1-8.

Olsen, Lars et al. (2017).

Ott, C. M. et al. (2015) "Large LNG Trains: Technology Advances to Address Market Challenges", *Gastech*, Singapore, Oct. 27-30, 2015, 10 pgs.

Publication No. 43031 (2000) Research Disclosure, Mason Publications, Hampshire, GB, Feb. 1, 2000, p. 239, XP000969014, ISSN: 0374-4353, paragraphs [0004], [0005] & [0006].

Publication No. 37752 (1995) Research Disclosure, Mason Publications, Hampshire, GB, Sep. 1, 1995, p. 632, XP000536225, ISSN: 0374-4353, 1 page.

Ramshaw, Ian et al. (2009) "The Layout Challenges of Large Scale Floating LNG," *ConocoPhillips Global LNG Collaboration*, 2009, 24 pgs, XP009144486.

Riordan, Frank (1986) "A Deformable Heat Exchanger Separated by a Helicoid," *Journal of Physics A: Mathematical and General*, v. 19.9, pp. 1505-1515.

Roberts, M. J. et al. (2004) "Reducing LNG Capital Cost in Today's Competitive Environment", PS2-6, *The 14th International Conference and Exhibition on Liquefied Natural Gas* (*LNG 14*), Doha, Qatar, Mar. 21-24, 2004, 12 pgs.

Shah, Pankaj et al. (2013) "Refrigeration Compressor Driver Selection and Technology Qualification Enhances Value for the Wheatstone Project." *17th Int'l Conf. & Exh. on LNG*, 27 pgs.

Tan, Hongbo et al. (2016) "Proposal and Design of a Natural Gas Liquefaction Process Recovering the Energy Obtained from the Pressure Reducing Stations of High-Pressure Pipelines," *Cryogenics*, Elsevier, Kidlington, GB, v.80, Sep. 22, 2016, pp. 82-90.

Tianbiao, He et al. (2015), Optimal Synthesis of Expansion Liquefaction Cycle for Distributed-Scale LNG, *Institute of Refrigeration and Cryogenics, Shanghai Jiao Tong University*, pp. 268-280.

Tsang, T. P. et al. (2009) "Application of Novel Compressor/Driver Configuration in the Optimized Cascade Process," *2009 Spring Mtg, and Global Conf. on Process Safety—9th Topical Conf. on Gas Utilization*, 2009, Abstract, 1 pg. https://www.aiche.org/conferences/aiche-spring-meeting-and-globalcongress- on-process- safety/2009/proceeding/paper/7a-application-novel-compressordriver-configurationoptimized-cascader-process.

* cited by examiner

CARGO STRIPPING FEATURES FOR DUAL-PURPOSE CRYOGENIC TANKS ON SHIPS OR FLOATING STORAGE UNITS FOR LNG AND LIQUID NITROGEN

CROSS REFERENCE TO RELATED APPLICATIONS

This application claims the priority benefit of U.S. Provisional Patent Application No. 62/904,966, filed Sep. 24, 2019, entitled CARGO STRIPPING FEATURES FOR DUAL-PURPOSE CRYOGENIC TANKS ON SHIPS OR FLOATING STORAGE UNITS FOR LNG AND LIQUID NITROGEN.

FIELD OF DISCLOSURE

The disclosure relates generally to the field of natural gas liquefaction to form liquefied natural gas (LNG). More specifically, the disclosure relates to the transport and storage of LNG and liquid nitrogen (LIN) in dual purpose tanks.

BACKGROUND

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

LNG is a rapidly growing means to supply natural gas from locations with an abundant supply of natural gas to distant locations with a strong demand for natural gas. The conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) transport of the LNG product in ships or tankers designed for this purpose to an import terminal associated with a market location; and e) re-pressurization and regasification of the LNG at a regasification plant to a pressurized natural gas that may distributed to natural gas consumers.

One method of natural gas liquefaction employs liquefied nitrogen (LIN) as the refrigerant. Because the nitrogen liquefaction temperature (−196° C.) is lower than the methane liquefaction temperature (−161° C.), LIN can be used advantageously to produce LNG. A challenge in using LIN for LNG production is transporting it to the liquefaction site. It has been proposed to use the otherwise empty LNG carriers to transport the LIN thereto. FIG. 1 shows an example of a method of transporting LNG and LIN in the same carriers, as disclosed in U.S. Patent Application Publication No. 2017/0167787, which is incorporated by reference herein in its entirety. An LNG cargo ship 100*a*, also called an LNG carrier, includes one or more dual-use tanks 101 designed to transport LNG and LIN therein at different times. LNG cargo ship 100*a* transports LNG from a liquefaction facility to an import terminal 104, where the LNG may be regasified. The liquefaction facility is shown as a floating LNG production (FLNG) facility 102 where natural gas is liquefied and stored, but alternatively may be an onshore LNG production facility, or even a floating production unit (FPU) that pretreats natural gas for liquefaction on the LNG cargo ship. After the LNG is unloaded, the dual-use tanks 101 are warmed to evaporate any remaining LNG. The tanks are then cooled down, and LIN is loaded into the tanks.

The LNG cargo ship 100*b*, now loaded with LIN, travels to the FLNG facility 102. The LIN is used to cool and liquefy natural gas to produce LNG. The dual-use tanks 101 are emptied of LIN and optionally warmed to evaporate any remaining LIN therein. Then LNG may be loaded into the dual-use tanks 101.

One challenge of using a dual-use tank 101 is that the process of transitioning between LNG to LIN at the import terminal 104 requires virtually all natural gas—liquefied or gaseous—be removed from the tank before LIN can be loaded therein. Inevitably there is a small amount of LNG remaining in the tank that the inlets of the lines for normal loading/unloading pumps cannot access. A smaller line, known as a stripping line, may be used to remove even more LNG, but even a stripping line does not remove all LNG from the tank. What remains must be heated and evaporated so it can be removed in a gaseous state. Because there is so much LNG remaining in the tank, generally the heating process requires heating all or a large portion of the tank to above LNG liquefaction temperature (−161° C.) to vaporize all remaining LNG. However, the more the tank is heated above LNG liquefaction temperature, the longer it will take to cool the tank to below a temperature suitable for LIN transport, i.e., the LIN liquefaction temperature (−196° C.). Known methods of LNG evaporation and tank cooling may take between 20 and 30 hours. Any methods to reduce this time would increase the time the LNG carrier is actually transporting LNG or LIN, thereby increasing profitability of the LNG transportation process. What is needed is needed is a method to reduce the time needed to transition a dual-use tank from storing LNG to storing LIN.

SUMMARY

The present disclosure provides a carrier for storing and transporting cryogenic liquids. A tank stores and transports a cryogenic liquid. A first pump fills the tank with the cryogenic liquid, and empties the tank of a first portion of the cryogenic liquid, thereby leaving a second portion of the cryogenic liquid in the tank. A tank structure focuses the second portion of the cryogenic liquid at a location on a bottom of the tank. A second pump is located at the location and empties the tank of the second portion of the cryogenic liquid so that a residual portion of the cryogenic liquid is left therein. A focused heating structure delivers heat to the location. The heat raises the temperature of the residual portion above the liquefaction temperature of the cryogenic liquid, thereby vaporizing all of the residual portion.

The present disclosure provides a method for transporting liquefied cryogenic liquids in a carrier. A cryogenic liquid is stored and transported in a dual-use cryogenic storage tank. A first pump is used to empty the cryogenic storage tank of a first portion of the cryogenic liquid, thereby leaving a second portion of the cryogenic liquid in the cryogenic storage tank. The second portion of the cryogenic liquid is focused at a location on a bottom of the cryogenic storage tank. A second pump, located at the location, empties the cryogenic storage tank of the second portion of the cryogenic liquid, whereby a residual portion of the cryogenic liquid is left therein. A focused heating structure delivers heat only to the location, and not to other parts of the cryogenic storage tank. The delivered heat raises the temperature of the residual portion above the liquefaction temperature of the cryogenic liquid, thereby vaporizing all of the residual portion.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
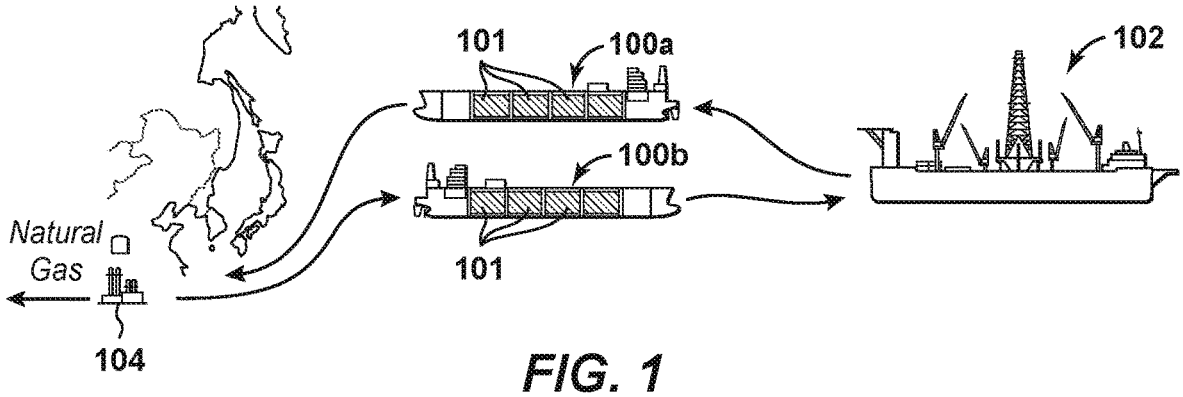
FIG. 1 (Prior Art)
FIG. 1 is a simplified diagram of a method of LNG liquefaction and regasification according to known principles.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. For the sake clarity, some features not relevant to the present disclosure may not be shown in the drawings.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

Figure 2:
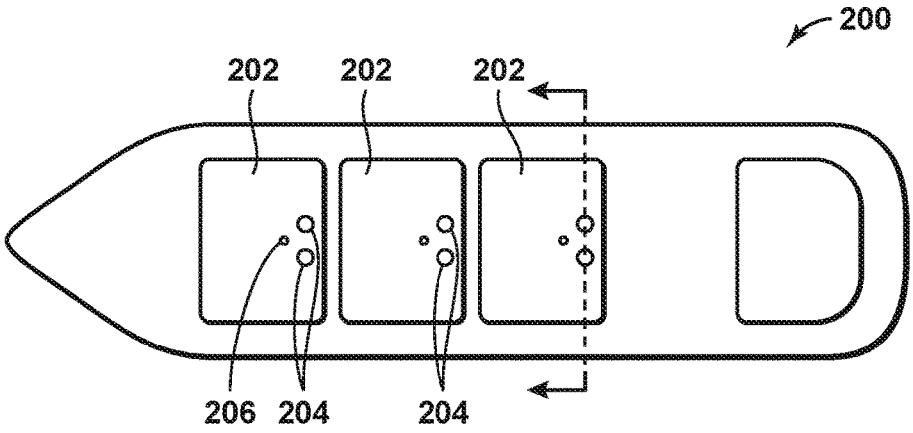
FIG. 2 is a top plan view of a cargo ship capable of carrying LNG and liquid nitrogen (LIN) according to aspects of the disclosure.

FIG. 2 is a top plan view of a cargo ship or carrier 200 having one or more dual-use storage tanks 202 according to disclosed aspects. The storage tanks are designed to carry both LNG and liquid nitrogen (LIN). Cryogenic loading/discharge lines 204 are used to fill and empty the storage tanks 202. Cryogenic loading/discharge lines are connected to piping (not shown) for loading and unloading LNG and LIN. A stripping line 206, smaller than the loading/discharge lines, is used to remove from the storage tanks the LNG or LIN that the loading/discharge lines are unable to remove. LNG extracted from storage tank 202 using stripping line 206 may be offloaded from the LNG cargo ship, or may be collected on a separate on-deck tank for use as fuel. LIN extracted from the storage tank using stripping line 206 may be stored and used as inert gas for purging the storage tank.

Figure 3A:
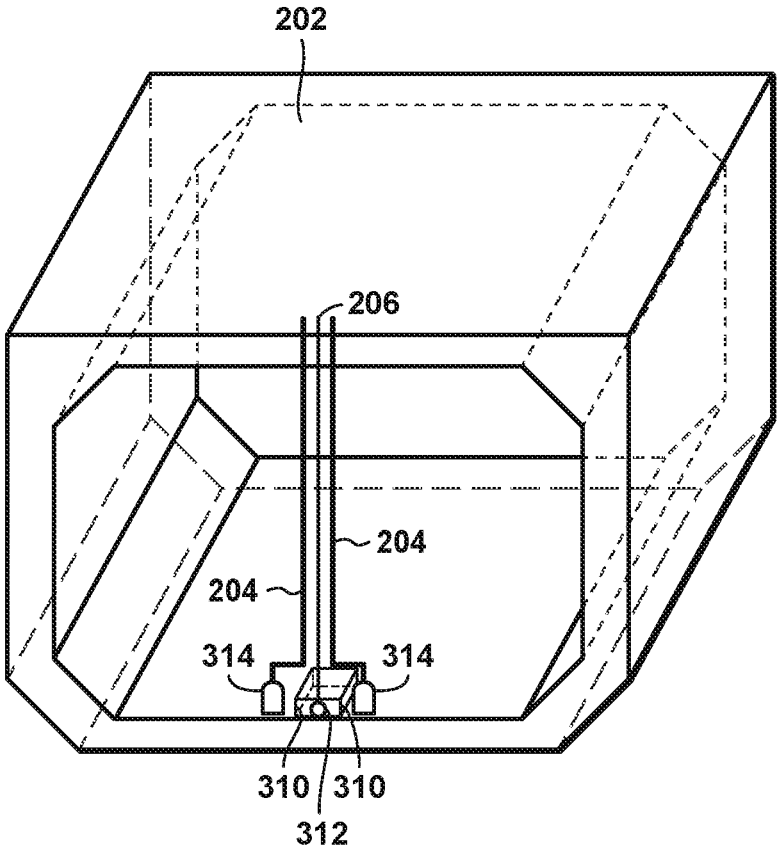
FIG. 3A is a cutaway perspective view of a storage tank on the cargo ship of FIG. 2 according to aspects of the disclosure.

FIGS. 3A-3K depict cross-sections of the storage tank 202, and details thereof, according to aspects of the disclosure. In each of the aspects disclosed in FIGS. 3A-3K, the storage tank and/or the drain systems have been designed to enable complete removal of cryogenic liquids, such as LNG or LIN. In FIG. 3A, raised corrugated and perforated baffles 310 are disposed at either side of the centerline of the storage tank 202. The baffles have a mild concave camber. A stripping pump 312 is situated between the baffles 310 and is connected to stripping line 206. Loading/discharge pumps 314 are disposed outside of baffles 310 and are connected to loading/discharge lines 204. Alternatively, stripping pump 312 and/or loading/discharge pumps 314 are disposed outside the storage tank 202. In an evacuation operation, the cargo ship naturally tilts so that liquid in the storage tank flows toward the loading/discharge pumps and the stripping pump. The loading/discharge pumps remove most of the cryogenic liquid from storage tank 202 through loading/discharge lines 204. Stripping pump 312 then evacuates the remnant cryogenic liquid through stripping line 206. Baffles 310 force the remnant cryogenic liquid to be concentrated within the baffles, where the stripping pump can readily access the remnant liquid. Using the baffles, more of the remnant liquid can be evacuated by the stripping pump than with known cryogenic tank designs that do not use baffles. Because less of the cryogenic remnant liquid remains in the storage tank, the storage tank may be heated for a shorter period of time, and the vaporization/cooling portion of the tank evacuation process may be significantly shortened.

Figure 3B:
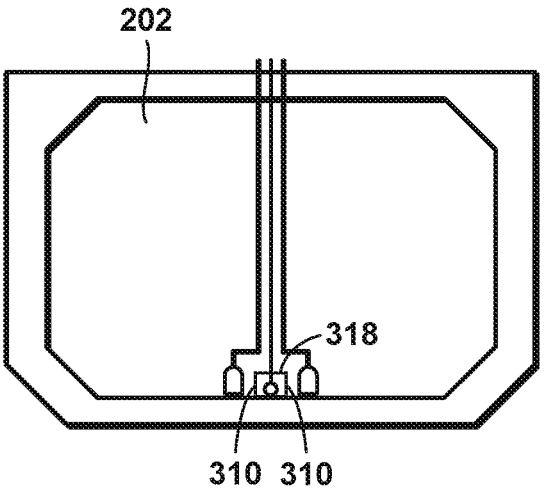
FIG. 3B is a cutaway side elevational view of a storage tank on the cargo ship of FIG. 2 according to aspects of the disclosure.

FIG. 3B shows tank 202 according to another aspect of the disclosure, in which a perforated top 318 is disposed on the baffles 310 to form a box-type structure around the stripping pump 312. The box-type structure further enhances performance of the stripping pump 312 by further concentrating the remnant cryogenic liquid around the stripping pump.

Figure 3C:
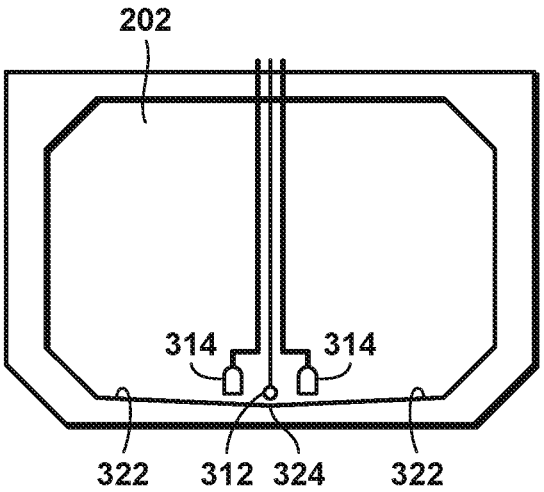
FIG. 3C is a cutaway side elevational view of a storage tank on the cargo ship of FIG. 2 according to aspects of the disclosure.
Figure 3D:
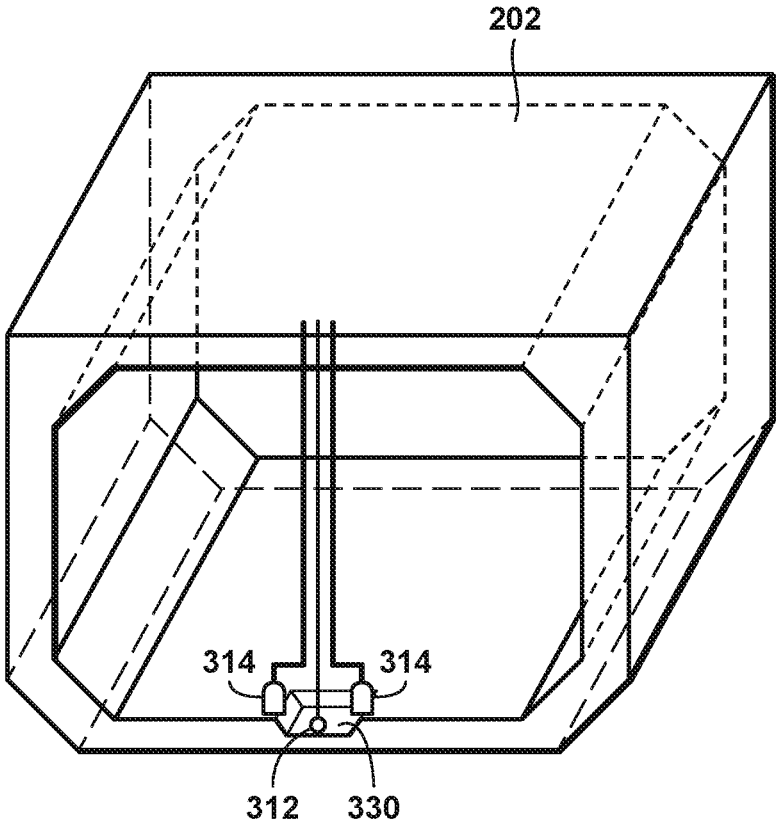
FIG. 3D is a cutaway perspective view of a storage tank on the cargo ship of FIG. 2 according to aspects of the disclosure.
Figure 3E:
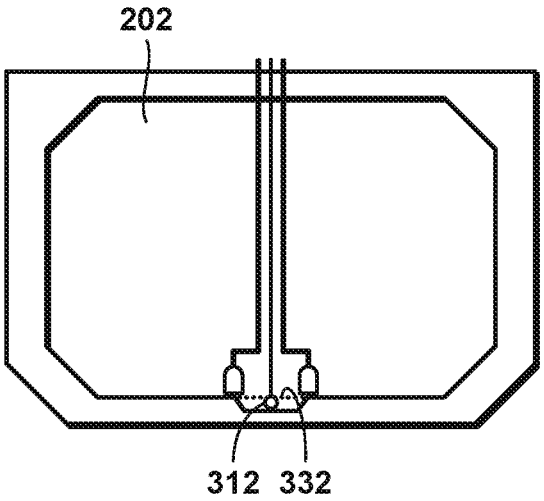
FIG. 3E is a cutaway side elevational view of a storage tank on the cargo ship of FIG. 2 according to aspects of the disclosure.

Instead of using baffles to concentrate the remnant cryogenic liquid to be adjacent the stripping pump, the shape of the storage tank itself may be modified to produce a similar effect. FIG. 3C shows a storage tank 320 in which the tank bottom 322 is downwardly slanted toward the stripping pump 312. The stripping pump is located at the lowest portion 324 of the tank bottom. Remnant cryogenic liquid will naturally collect adjacent the stripping pump, thereby easing the process of removing the remnant cryogenic liquid. The downwardly slanted tank bottom 322 may prevent the loading/discharge pumps 314 from being situated as low in the storage tank as previously disclosed aspects, however. FIG. 3D shows tank 202 according to another aspect of the disclosure, in which a pump gutter or pump well 330 is made at the bottom of the storage tank. Stripping pump 312 is placed within the pump well 330 to remove as much remnant cryogenic liquid as possible. Loading/discharge pumps 314 are located as close to the bottom of the storage tank as possible to minimize the amount of remnant cryogenic liquid in the storage tank. FIG. 3E depicts a tank 202 with a variation of FIG. 3D in which a perforated top 332 is placed on the pump well 330 to create a box-like structure which, like top 318 in FIG. 3B, further concentrates the remnant cryogenic liquid around stripping pump 312.

Figure 3F:
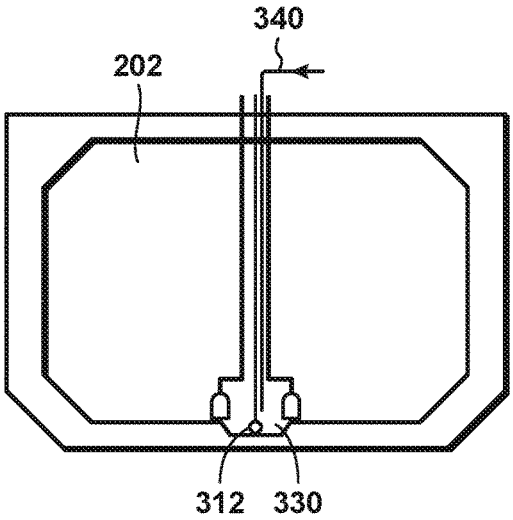
FIG. 3F is a cutaway side elevational view of a storage tank on the cargo ship of FIG. 2 according to aspects of the disclosure.
Figure 3G:
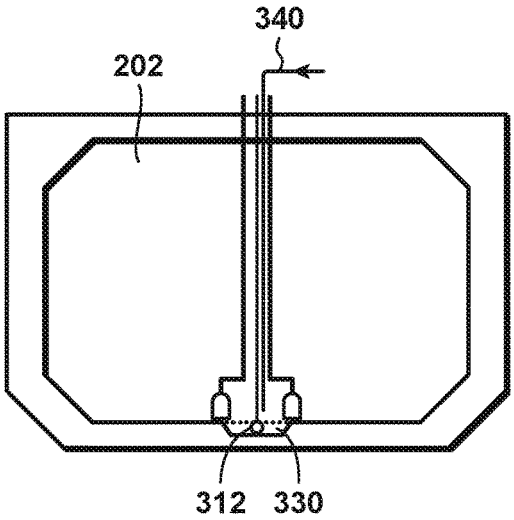
FIG. 3G is a cutaway side elevational view of a storage tank on the cargo ship of FIG. 2 according to aspects of the disclosure.

Aspects of the disclosure as described above concentrate remnant cryogenic liquid at a specific location—adjacent the stripping pump—on the floor of a cryogenic storage tank. Not only does this enable more of the remnant cryogenic liquid to be evacuated from the tank using the stripping pump, but the remnant liquid that cannot be evacuated by the stripping pump or the loading/discharge pumps is still concentrated adjacent the stripping pump. This liquid, termed herein the "residual liquid", can only be removed through vaporization, but because of its localized concentration only a small portion of the storage tank needs to be heated to vaporize it. FIGS. 3F and 3G show tanks 202 constructed similar to FIGS. 3D and 3E, respectively, with the addition of an insulated warm gas injection line 340 having an outlet within the pump well 330 and adjacent the stripping pump 312. Warm gas, such as nitrogen, may be pumped into the pump well 330 at a temperature higher than the liquefaction temperature of the cryogenic liquid being evacuated from the storage tank, after operation of the stripping pump 312. Residual liquid, all of which is concentrated in the pump well 330, is vaporized and can then be removed from the storage tank 202. It can be seen that only the pump well 330, and the portion of the storage tank directly adjacent thereto, is warmed by the warm gas injected therein. Consequently, the temperature of the storage tank has not warmed appreciably, and therefore the time required to cool the storage tank for use with other cryogenic liquids, such as LIN, has been significantly reduced when compared to known storage tank designs. The aspects depicted in FIGS. 3F and 3G may also be implemented with the baffle structures disclosed in FIGS. 3A and 3B, or with the slanted floor disclosed in FIG. 3C.

Figure 3H:
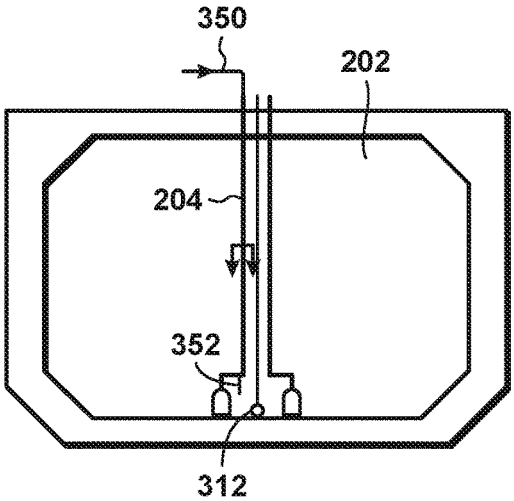
FIG. 3H is a cutaway side elevational view of a storage tank on the cargo ship of FIG. 2 according to aspects of the disclosure.
Figure 3I:
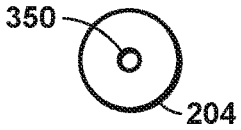
FIG. 3I is a cutaway view of a loading/discharge line shown in FIG. 3H.

Other methods of localized storage tank heating may be implemented. FIGS. 3H and 3I show a tank 202 according to another aspect of the disclosure in which a warm gas injection line 350 is inserted into one or more of the loading/discharge lines 204 and run to an outlet 352 adjacent stripping pump 312. Warm gas, such as nitrogen or other gas, is pumped out of the outlet 352 only when liquids are not being evacuated from or discharged into the storage tank 202, and preferably only after stripping pump 312 has removed as much remnant cryogenic liquid as possible.

Figure 3J:
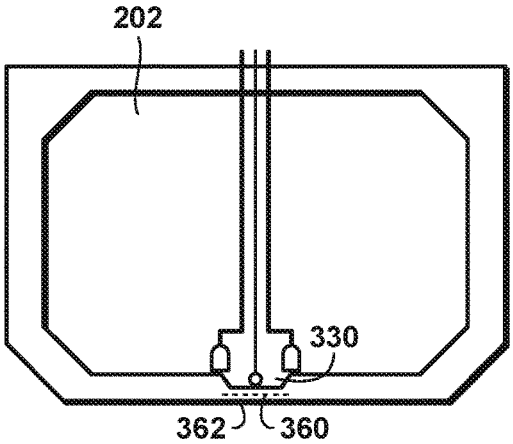
FIG. 3J is a cutaway side elevational view of a storage tank on the cargo ship of FIG. 2 according to aspects of the disclosure.
Figure 3K:
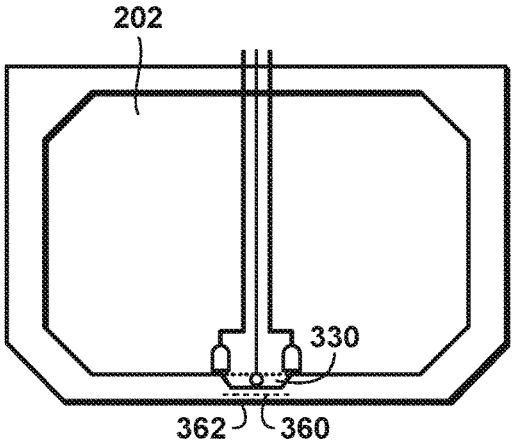
FIG. 3K is a cutaway side elevational view of a storage tank on the cargo ship of FIG. 2 according to aspects of the disclosure.

FIGS. 3J and 3K show tanks 202 according to another aspect of the disclosure in which, instead of inserting a heating medium through the top of the storage tank, a heating system 360 is installed into or under the bottom floor 362 of the storage tank. Specifically, the heating system 360 may be localized and placed directly under the location where the residual liquid has been collected, which in FIGS. 3J and 3K comprise the pump well 330. Heating system 360 may comprise electrical heating elements or, alternatively, a series of pipes built into the bottom floor 362 through which a heating fluid may be directed. The heating fluid may comprise a gas, such as ambient air or nitrogen gas, or may comprise a liquid, such as water or glycol. The heating system provides sufficient heat to vaporize the residual liquid. By heating only the pump well 330 and possibly the adjacent portions of the storage tank, the temperature increase in the tank during the vaporization procedure is minimized. The aspects depicted in FIGS. 3J and 3K may also be implemented with the baffle structures disclosed in FIGS. 3A and 3B, or with the slanted floor disclosed in FIG. 3C.

Figure 4A:
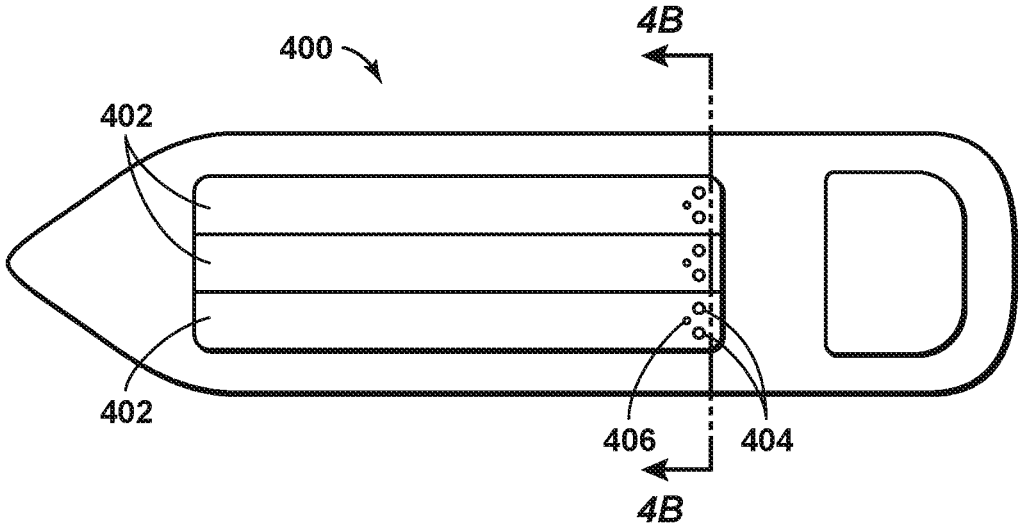
FIG. 4A is a top plan view of a cargo ship capable of carrying LNG and liquid nitrogen (LIN) according to other aspects of the disclosure.
Figure 4B:
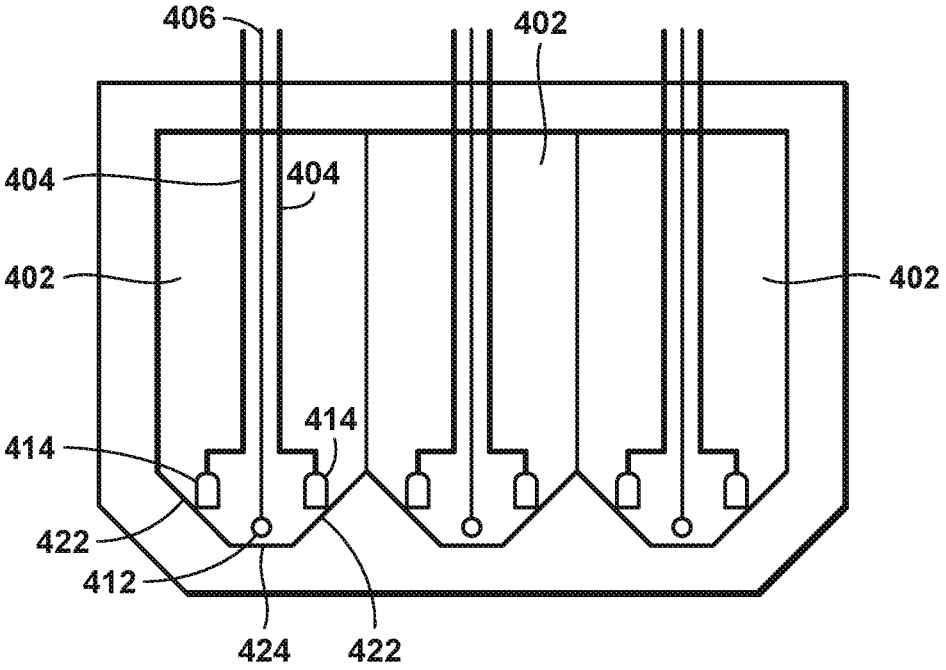
FIG. 4B is a cutaway side elevational view of storage tanks on the cargo ship of FIG. 4A according to aspects of the disclosure.

FIG. 4A is a top plan view of a cargo ship or carrier 400 having one or more storage tanks 402 according to another aspect of the disclosure. In comparison to storage tanks 202 previously described, storage tanks 402 have a significant longitudinal dimension parallel to the length of the cargo ship 400. The storage tanks are designed to carry both LNG and liquid nitrogen (LIN). Cryogenic loading/discharge lines 404 are used to fill and empty the storage tanks 402. Cryogenic loading/discharge lines are connected to piping (not shown) for loading and unloading LNG and LIN. A stripping line 406, smaller than the loading/discharge lines, is used to remove from the storage tanks the LNG or LIN that the loading/discharge lines are unable to remove. LNG extracted from storage tank 402 using stripping line 406 may be offloaded from the LNG cargo ship, or may be collected on a separate on-deck tank for use as fuel. LIN extracted from the storage tank using stripping line 406 may be stored and used as inert gas for purging the storage tank. As shown in FIG. 4B, opposing sides 422 of the bottom 422 of each tank slant toward a central portion 424 of the tank bottom. A stripping pump 412, connected to stripping line 406, is located adjacent the central portion 424. Loading/discharge pumps 414 are connected to the loading discharge lines 404. During an unloading process, loading/discharge pumps 414 evacuate most of the cryogenic liquid, and the stripping pump 412 evacuates the remnant liquid that the loading/discharge pumps cannot evacuate. In this or other aspects, the time when the loading/discharge pumps and the stripping pump are active may overlap. Disclosed methods may be used to heat and vaporize the residual liquid, i.e., liquid that the loading/discharge pumps cannot evacuate.

Figure 5:
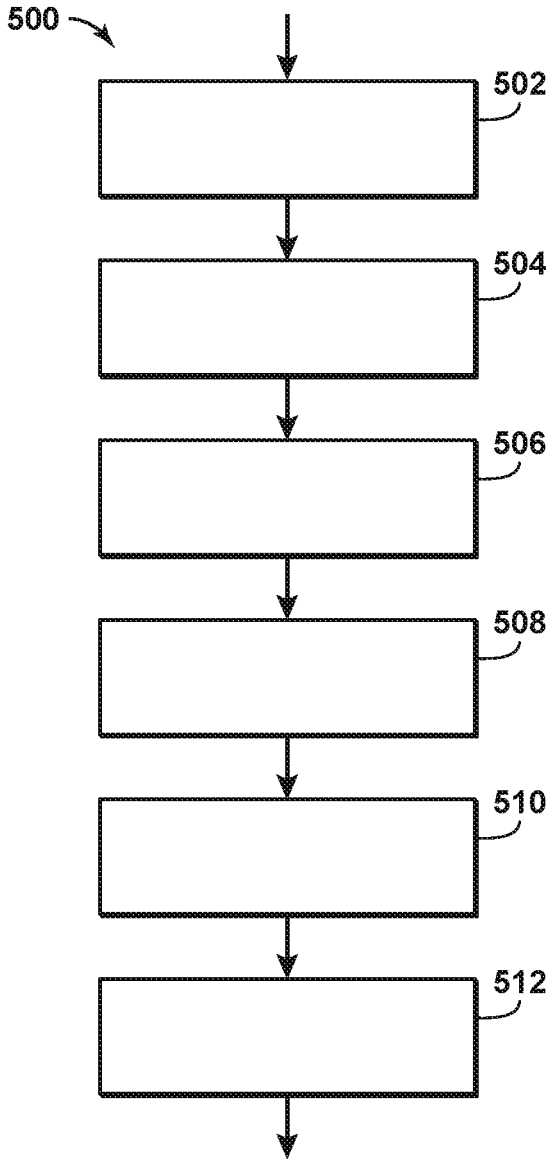
FIG. 5 is a method for transporting liquefied cryogenic liquids in a carrier according to aspects of the disclosure.

FIG. 5 is a flowchart of a method 500 for transporting liquefied cryogenic liquids in a carrier according to disclosed aspects. At block 502, a cryogenic liquid is stored and transported in a dual-use cryogenic storage tank. At block 504, a first pump is used to empty the cryogenic storage tank of a first portion of the cryogenic liquid, thereby leaving a second portion of the cryogenic liquid in the cryogenic storage tank. At block 506, the second portion of the cryogenic liquid is focused at a location on a bottom of the cryogenic storage tank. At block 508 a second pump, located at the location, empties the cryogenic storage tank of the second portion of the cryogenic liquid, whereby a residual portion of the cryogenic liquid is left therein. At block 510 a focused heating structure delivers heat only to the location, and not to other parts of the cryogenic storage tank. The delivered heat raises the temperature of the residual portion above the liquefaction temperature of the cryogenic liquid, so that at block 512 all of the residual portion is vaporized.

The steps depicted in FIG. 5 are provided for illustrative purposes only and a particular step may not be required to perform the disclosed methodology. Moreover, FIG. 5 may not illustrate all the steps that may be performed. The claims, and only the claims, define the disclosed system and methodology.

The aspects described herein have several advantages over known technologies. As previously discussed, directing the remnant cryogenic liquid to the stripper pump using baffles, box-like structures, pump wells, or slanted tank bottoms results in more of the remnant liquid being evacuated using the stripper pump. Consequently, there is less residual liquid to be heated and vaporized, and the vaporization process takes less time than known technologies. Additionally, because the residual liquid is concentrated or focused in one place (i.e., between the baffles, within the pump wells, etc.), the means to heat and vaporize the residual liquid (warm gas injection lines, heating elements) may be focused at that place, instead of throughout the storage tank as is done with known storage tanks. The focused heating reduces the temperature of the entire storage tank after vaporization is complete, thereby reducing the time needed to cool the storage tank for the next load of cryogenic liquid. Combined, the disclosed methods of concentrating remnant liquid and the methods of focused heating substantially reduce the time required to prepare a storage tank emptied of, for example, LNG, to be filled with, for example, LIN. Such time reduction may be as much as 30%, or 40%, or 50%, or even 50% of the preparation time required by known technologies.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A carrier for storing and transporting cryogenic liquids, comprising:

a tank configured to store and transport a cryogenic liquid having a liquefaction temperature;

a first pump configured to fill the tank with the cryogenic liquid and empty the tank of a first portion of the cryogenic liquid, thereby leaving a second portion of the cryogenic liquid in the tank;

a tank structure that focuses the second portion of the cryogenic liquid at a location on a bottom of the tank;

a second pump located at the location and configured to empty the tank of the second portion of the cryogenic liquid except for a residual portion of the cryogenic liquid that is left therein; and a focused heating structure configured to deliver heat to the location on the bottom of the tank;

wherein the heat is configured to raise a temperature of the residual portion above the liquefaction temperature, thereby vaporizing all of the residual portion.

2. The carrier of claim 1, wherein the tank structure comprises baffles surrounding the second pump, the baffles being attached to the bottom of the tank.

3. The carrier of claim 2, further comprising a baffle top that encloses the second pump within the baffles, the baffle top, and the bottom of the tank.

4. The carrier of claim 1, wherein the tank structure comprises a pump well at the bottom of the tank, the pump well comprising an indented portion of the bottom of the tank into which the second pump is situated.

5. The carrier of claim 4, further comprising a pump well top that covers the pump well and encloses the second pump in the pump well.

6. The carrier of claim 1, wherein the focused heating structure comprises a gas injection line having an outlet adjacent the second pump, the gas injection line being configured to introduce a gas at the location at the bottom of the tank, the gas having a temperature above the liquefaction temperature.

7. The carrier of claim 6, further comprising a first pump line connected to the first pump and configured to transport the cryogenic liquid in or out of the tank, wherein the gas injection line is disposed within the first pump line.

8. The carrier of claim 1, wherein the focused heating structure comprises a heating element disposed underneath the location on the bottom of the tank, wherein the heating element is configured to heat the residual portion of the cryogenic liquid above the liquefaction temperature.

9. A method of transporting liquefied cryogenic liquids in a carrier, comprising:

in a dual-use cryogenic storage tank, storing and transporting a cryogenic liquid having a liquefaction temperature;

using a first pump to empty the cryogenic storage tank of a first portion of the cryogenic liquid, thereby leaving a second portion of the cryogenic liquid in the cryogenic storage tank;

focusing the second portion of the cryogenic liquid at a location on a bottom of the cryogenic storage tank; and using a second pump located at the location, emptying the cryogenic storage tank of the second portion of the cryogenic liquid except for, a residual portion of the cryogenic liquid that is left therein.

10. The method of claim 9, wherein the second portion of the cryogenic liquid is focused using baffles surrounding the second pump, the baffles being attached to the bottom of the cryogenic storage tank.

11. The method of claim 10, wherein a baffle top that encloses the second pump between the baffles, the baffle top, and the bottom of the cryogenic storage tank.

12. The method of claim 9, wherein the second portion of the cryogenic liquid is focused using a pump well at the bottom of the cryogenic storage tank, the pump well comprising an indented portion of the bottom of the cryogenic storage tank into which the second pump is situated.

13. The method of claim 12, wherein a pump well top covers the pump well and encloses the second pump in the pump well.

14. The method of claim 9, wherein the second portion of the cryogenic liquid is focused using a slanted tank bottom that slants downwardly from opposite sides of the cryogenic storage tank.

15. The method of claim 9, further comprising:

delivering heat only to the location using a focused heating structure; and using the focused heating structure, raising a temperature of the residual portion above the liquefaction temperature, thereby vaporizing all of the residual portion.

16. The method of claim 15, wherein the focused heating structure comprises a gas injection line having an outlet adjacent the second pump, the method further comprising:

using the gas injection line, introducing a gas at the location at the bottom of the cryogenic storage tank, the gas having a temperature above the liquefaction temperature.

17. The method of claim 16, further comprising:

transporting the cryogenic liquid in or out of the cryogenic storage tank using a first pump line connected to the first pump;

wherein the gas injection line is disposed within the first pump line.

18. The method of claim 15, wherein the focused heating structure comprises a heating element disposed underneath the location on the bottom of the cryogenic storage tank, the method further comprising:

using the heating element, heating the residual portion of the cryogenic liquid above the liquefaction temperature.

19. The method of claim 15, wherein the cryogenic liquid is a first cryogenic liquid, the method further comprising:

after the residual portion is vaporized, cooling the cryogenic storage tank to a temperature that is at or below a liquefaction temperature of a second cryogenic liquid, wherein a composition of the second cryogenic liquid is different from a composition of the first cryogenic liquid; and filling the cryogenic storage tank with the second cryogenic liquid.

* * * * *